United States Patent [19]

Lyerly

[11] 3,949,673

[45] Apr. 13, 1976

[54] SEMI-RIGID SINUOUS BLASTING CHARGE AND BOREHOLE LOADING METHOD

[75] Inventor: William Marcelle Lyerly, Hagerstown, Md.

[73] Assignee: E. I. DuPont de Nemours and Company, Wilmington, Del.

[22] Filed: Apr. 16, 1974

[21] Appl. No.: 461,359

[52] U.S. Cl. ..... 102/24 R; 86/20 C

[51] Int. Cl.[2] ..... F42B 3/00

[58] Field of Search ..... 102/22–24; 86/20 C

[56] References Cited

UNITED STATES PATENTS

| | | | |
|---|---|---|---|
| 2,755,878 | 7/1956 | Smith | 102/21 |
| 3,273,337 | 9/1966 | Bolieau | 102/24 |
| 3,318,242 | 5/1967 | Griffith | 102/24 |
| 3,384,688 | 5/1968 | Gow et al. | 102/27 |
| 3,534,685 | 10/1970 | Romocki et al. | 102/24 |
| 3,590,739 | 7/1971 | Persson | 102/27 |
| 3,610,089 | 10/1971 | Cook et al. | 102/22 |
| 3,691,954 | 9/1972 | Kern | 102/24 |
| 3,793,954 | 2/1974 | Johnston | 102/24 |

FOREIGN PATENTS OR APPLICATIONS

| | | | |
|---|---|---|---|
| 521,726 | 3/1955 | Italy | 53/46 |

*Primary Examiner*—Verlin R. Pendegrass

[57] ABSTRACT

A blasting charge, e.g., for pre-splitting, easy to load into boreholes and to maintain in wet boreholes when the charge density is low, comprising an elongated sinuous length of semi-rigid tubing, e.g., polyethylene, laden with explosive, e.g., a water-bearing explosive, the charge having sufficient rigidity that when unwound from a coil and fed into a borehole it retains a degree of curvature and exerts pressure against the wall of the borehole. Loading explosive into a borehole by unwinding a coiled length of semi-rigid explosive-laden tubing and feeding the tubing into the hole, the leading end of the tubing being provided with explosives-retaining means, e.g., a 180° bend in the tubing together with a sleeve fitting over the bent portion of the tubing.

11 Claims, 3 Drawing Figures

SEMI-RIGID SINUOUS BLASTING CHARGE AND BOREHOLE LOADING METHOD

BACKGROUND OF THE INVENTION

1. Field of the Invention

The present invention relates to a blasting charge comprising a blasting composition, e.g., a water-bearing explosive, supported within a sinuous length of semi-rigid tubing, and to a method of loading explosive into a borehole from a coil of semi-rigid tubing laden with the explosive.

2. Description of the Prior Art

Water-bearing explosives, which typically comprise an oxidizing component and a fuel component dispersed or dissolved in an aqueous medium that normally is thickened or gelled, currently are available in the form of small-diameter charges for use in underground blasting operations. The most commonly available form of charge is a cartridge comprised of a tube of plastic film, filled with explosive, and gathered at both ends and closed, e.g., by means of metal closure bands around the gathered portions. An elongated flexible charge comprised of explosive encased in plastic film also has been described.

The currently known water-bearing explosive charges frequently are not suitable for use in controlled blasting operations, e.g., in pre-shearing or pre-splitting wherein the boreholes need to be loaded with relatively light explosive charges. The required light weight necessitates the use of charge diameters generally of about 1.5 inches or less, and the difference between the charge diameter and borehole diameter may be about 0.5 inch or more. Because of the difference in these diameters, and because of the deformability or flexibility of the charges, as well as the possibility that the packaging film may rupture when high poling force is exerted during loading, it is difficult to achieve the low charge weight uniformly throughout the length of the borehole with such charges. Furthermore, the low charge weight may necessitate the use of an explosive charge having a low density, i.e., a density of less than one gram per cubic centimeter. Explosive charges of such density packaged in plastic film according to the prior art are difficult to maintain in water-containing boreholes because of the buoyancy effect of the water.

SUMMARY OF THE INVENTION

The present invention provides a blasting charge that can readily be loaded uniformly throughout the length of a borehole irrespective of the difference between the diameter of the explosive and the borehole diameter, and can be maintained in place in wet boreholes even when the density of the explosive is low, the blasting charge comprising an elongated sinuous length of tubing, e.g., at least about 5 feet, and usually about 20 to 30 feet, in axial length, laden with and supporting a substantially continuous column of explosive, e.g., a water-bearing or other extrudable explosive, the flexural modulus of the tubing material and the wall thickness and diameter of the tubing being such that when the tubing in compactly coiled form is unwound and fed into a borehole, the tubing retains a degree of curvature (sinuosity) and exerts pressure against the borehole wall. Preferably the explosive is placed in the tubing by pumping into coiled tubing, and for this reason the properties of the tubing preferably are such that the tubing can be coiled compactly, e.g., to a diameter in the range of about from 15 to 50 inches without kinking.

In order that the tubing have the capability of being coiled as described and of retaining the described degree of curvature, the tubing is semi-rigid, i.e., is made from a material which has a flexural modulus in the range of about from 6000 to 120,000 psi, and has a ratio of tubing inner diameter to wall thickness in the range of about from 10/1 to 50/1, and a tubing wall thickness of at least about 0.0005 inch. Preferably the tubing is made of plastic, e.g., a polyolefin.

This invention also provides a method of loading explosive into a borehole comprising a. providing a length of tubing, which is laden with and supports a substantially continuous column of explosive, in the form of a compact coil having a diameter in the range of about from 15 to 50 inches, an end of the tubing being provided with means for retaining the explosive therein, e.g., an approximately 180° bend near the end together with a retaining sleeve which fits around and frictionally engages the bent-back portion of tubing and the portion of tubing adjacent thereto; and b. unwinding and feeding the coiled explosive-laden tubing into a borehole, the tubing being sufficiently rigid that the explosive-laden tubing fed into the borehole retains a degree of curvature and exerts pressure against the wall of the borehole, the end of the tubing provided with said explosives-retaining means being the leading end thereof.

BRIEF DESCRIPTION OF THE DRAWING

The blasting charge and the borehole loading method of the invention will be described with reference to the attached drawing in which.

DETAILED DESCRIPTION

Figure 1:
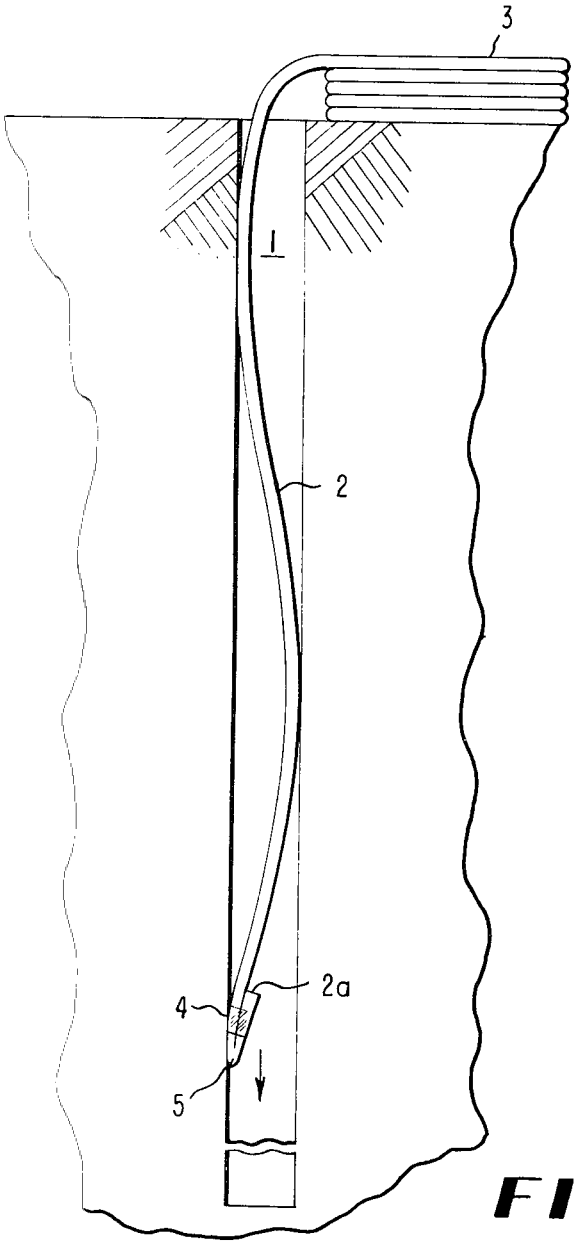
FIG. 1 is a view in elevation of a borehole into which explosive is being loaded by the method of the invention.

The blasting charge of this invention, i.e., the charge in the form in which it is present in a borehole and in condition for blasting, is elongated and sinuous, i.e., serpentine, curved, or winding, generally in the form of an axially elongated coil or helix in which the length of the turns, for example, is at least about 4 feet and can be much greater, e.g., about 15 feet. Prior to being loaded in a borehole, however, the sinuous charge can be compactly coiled. The sinuosity of the charge is self-maintained, being a result of the relatively high degree of rigidity of the sinuous explosive-supporting tubing which constitutes a part of the charge. This is in contrast to flexible charges which, when assembled in a borehole for blasting, are linear, but can be stored in a curved configuration if provided with suitable outside support, e.g., a spool on which they can be wound or coiled, or a horizontal base support on which they can be stack-coiled. When the support is removed and, for example, such flexible charges are loaded into boreholes, they revert to a linear configuration.

In the charge of the present invention, the rigidity of the explosive-supporting tubing which enables the sinuosity of the charge to be self-maintained enables the charge to be pushed easily into a borehole and uniform loading of the borehole to be achieved despite large differences between the diameter of the boreholes and the diameter of the explosive column. Furthermore, the rigidity of the tubing is sufficient that the charge exerts pressure against the wall of a borehole into which it is loaded. This causes the charge to be anchored in the hole and prevents it from floating out of water-containing boreholes.

In the interest of efficiency, the charge will be made from a long length, e.g., about 30 feet or more, of tubing, which will be charged with explosive either at the blast site or prior to its arrival at the blast site, the latter situation being preferred on the basis of convenience. To achieve sinuosity in the blasting charge, the long length of tubing is coiled, and preferably compactly to facilitate handling. As a practical matter, tubing wound to a coil diameter (outer) in the range of about from 15 to 50 inches generally will be used, with substantially no space between adjacent turns of the coil. Extrudable explosive compositions can be extruded into the tubing as the tubing is being formed, and the explosive-laden tubing subsequently coiled. Water-bearing explosive can be introduced into the tubing by pumping (a) before the tubing has been coiled, (b) while the tubing is in the form of a compact coil, or (c) after the compactly coiled tubing has been unwound to an elongated coil, before or after the latter has been positioned in the borehole. However, a preferred procedure is to pump the explosive into the compactly coiled tubing, and to store and ship the explosive-laden tubing in this form. In the latter case, in order to provide a substantially continuous column of explosive in the present charge, and thus a uniform explosive load in the borehole, the coiled tubing should be kink-free. Therefore, the degree of rigidity of the tubing, a function of the flexural modulus of the tubing material and of the ratio of the tubing's diameter to its wall thickness, preferably is such that the tubing can be coiled to a convenient diameter, e.g., in the above-specified range, without kinking.

The diameter of the tubing will depend on the weight of explosive required to be loaded into a borehole and on the density of the explosive used. In many instances, e,.g., for pre-splitting operations, the charge diameter, and therefore the inner diameter of the tubing, will be less than about 1.5 inches. In order to facilitate pumping of water-bearing explosive into such tubing, the viscosity of the explosive at the time it is being pumped will be kept relatively low, e.g., below about 8000 centipoises, and preferably below about 5000 centipoises.

If the explosive is not sufficiently stiff to be retained within the tubing, or, as in the preferred case, the explosive is pumped into compactly coiled tubing and the explosive-laden coiled tubing is to be stored for a period of time prior to use, it may be necessary or desirable to provide both ends of the tubing with means for retaining the explosive therein. A preferred retaining means is an approximately 180° bend near the end of the tubing combined with a sleeve, e.g., made of thin plastic, or other holding device which fits around and frictionally engages the bent-back portion of tubing so as to hold it in bent position. At the time that the coil is unwound and the tubing fed into the borehole, the leading end of the tubing should be provided with explosives-retaining means. Other explosives-retaining means can be, for example, a plug, or an end cap held in place, if necessary, by tape or the like.

At the time of use, the preferably explosive-laden, compactly coiled tubing is unwound sufficiently that it can be fed into the borehole, which has a diameter that is larger than the outer diameter of the tubing and considerably smaller than the outer diameter of the coil. The coil lengthens to an appreciable degree axially, e.g., as a result of the compressive force exerted by the surrounding formation, but the rigidity of the tubing is sufficient to cause the tubing to retain a degree of curvature, i.e., sinuosity, as well as to exert pressure against the borehole wall.

By way of an example, and with reference to FIG. 1, 1 is a borehole in a rock formation, the borehole having a diameter of 3.5 inches and a depth of 30 feet; 2 is a length of tubing made of free-radical-polymerized low-density polyethylene having a flexural modulus of 40,000 – 45,000 psi as measured at 23° by ASTM-D-790. The polyethylene tubing 2 has an inner diameter of 0.88 inch and a wall thickness of 0.05 inch. Tubing 2 is laden with and supports a substantially continuous column of water-bearing explosive having the following composition, by weight: 34.4 percent ammonium nitrate, 14.3 percent sodium nitrate, 9.8 percent water, 36.9 percent monomethylamine nitrate, 3.7 percent perlite (an air-containing volcanic glassy material), 0.6 percent guar gum, and 0.2 percent of a proteinaceous foam stabilizer. This composition has a density of 0.9 gram per cubic centimeter.

Tubing 2 has been wound in the form of a compact coil 3, from which it is shown being unwound and fed into borehole 1, moving toward the bottom thereof. Coil 3 is made by winding 50 feet of tubing 2 to an outer diameter of 26 inches. The water-bearing explosive has been pumped into the kink-free coil 3 at a viscosity of 5000 centipoises. The leading end of tubing 2 is provided with means for retaining the explosive therein, i.e., an approximately 180° bend 5 in the tubing together with a polyethylene sleeve 4 which fits around the bent-back end portion of the tubing and the portion of tubing adjacent thereto. The explosive-laden length of tubing 2 within borehole 1 is sinuous and presses against the borehole wall.

The ability of the tubing in the present charge to retain a degree of curvature and exert pressure against the wall of a borehole into which it is fed after being unwound from a coil, and in the preferred case to be coiled to a diameter in the range of about from 15 to 50 inches without kinking, results from the semi-rigidity of the tubing. More specifically, the tubing is made of a material which can be flexed to a limited degree without fracturing, i.e., has a flexural modulus in the range of about from 6000 to 120,000 psi, and preferably from 8000 to 60,000 psi, while at the same time the ratio of the inner diameter to the wall thickness of the tubing is in the range of about from 10/1 to 50/1, and the tubing wall is at least 0.005 inch thick. Suitable tubing materials include thermoplastic as well as elastomeric materials, formulated with plasticizers or curing agents if required to achieve the proper modulus. Plastics which can be used include, for example, polyolefins, partially plasticized polyvinyl chloride, and polyamides. Polyolefins such as polyethylene and polypropylene are preferred materials for the reason that they can provide the proper modulus without the need of plasticizers. Of the polyolefins, polyethylene is especially preferred for economical reasons.

Generally, tubing wall thickness in the range of about from 0.015 to 0.070 inch will be used, with tubing inner diameters of about from 0.37 to 1.25 inches.

Figure 2:
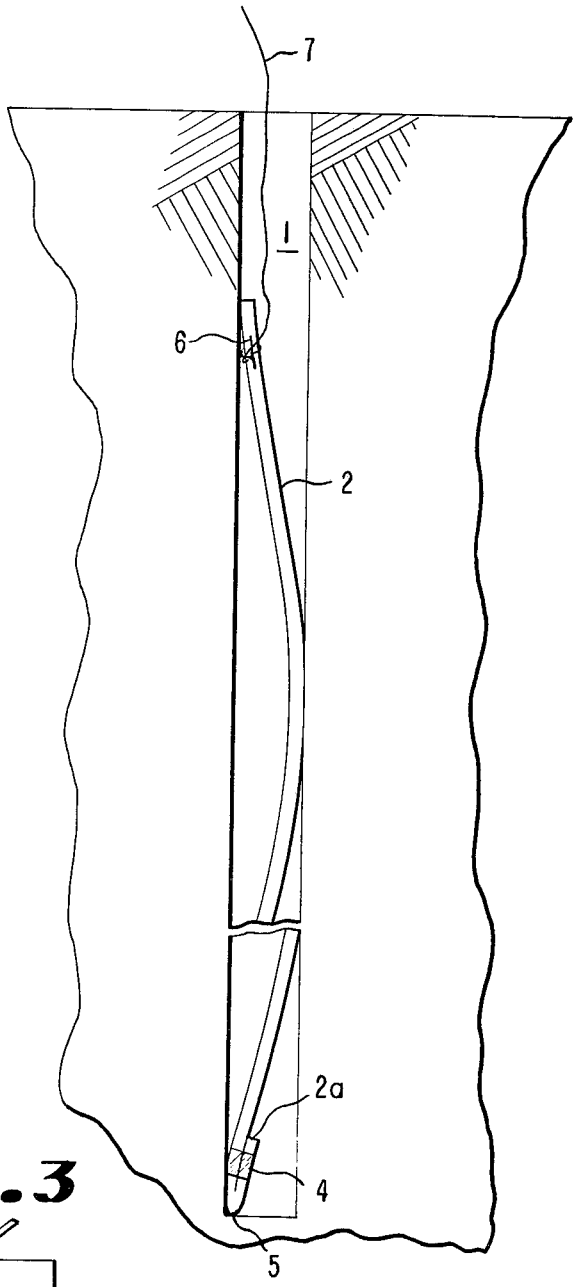
FIG. 2 is a view in elevation of a blasting assembly wherein the blasting charge of the invention is assembled in a borehole together with initiation means therefor.
Figure 3:
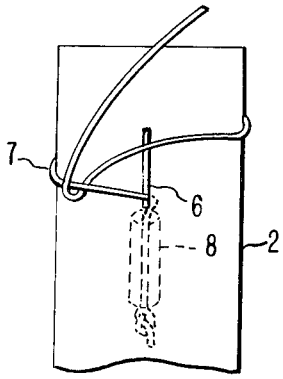
FIG. 3 is an enlarged view of a portion of the assembly shown in FIG. 2.

Although any conventional means of initiating the explosive can be used, e.g., a blasting cap or detonating cord, in a preferred embodiment of the invention the charge is initiated by a length of detonating cord, which in turn can be connected to a detonating cord trunk line along with cords from charges in other boreholes. In a preferred blasting assembly, shown in FIGS. 2 and 3, the explosive-laden length of tubing 2 described with reference to FIG. 1 has a slot 6 in its wall through which a length of detonating cord 7, e.g., 25-grain per foot "E-cord", passes, the end of the cord being embedded in the explosive in the tubing. A cylindrical stiffening member 8, e.g., a plastic sleeve (FIG. 3), fits around the cord, and one end of the cord is knotted to enable retention of the stiffening member on the cord. The stiffening member permits easy insertion into the explosive. The other end of the detonating cord leads to a trunk line, which in turn is connected to a source of initiation energy, e.g., a blasting cap. This blasting assembly is used in conjunction with other assemblies in a pre-shearing blast to produce a fractured zone between boreholes prior to a subsequent primary blast.

I claim:

1. A blasting charge comprising an elongated sinuous length of tubing laden with and supporting a substantially continuous column of explosive, the flexural modulus of the tubing material and the wall thickness and diameter of the tubing being such that when the tubing in compactly coiled form is unwound and fed into a borehole having a diameter which is smaller than the outer diameter of the coil, the tubing retains a degree of curvature and exerts pressure against the wall of the borehole.

2. A blasting charge comprising an elongated sinuous length of tubing laden with and supporting a substantially continuous column of explosive, the flexural modulus of the tubing material being in the range of about from 6000 to 120,000 psi, the wall thickness of said tubing being at least about 0.005 inch, and the ratio of the inner diameter to the wall thickness of said tubing being in the range of about from 10/1 to 50/1.

3. A blasting charge of claim 1 wherein said tubing is made of plastic.

4. A blasting charge of claim 3 wherein said plastic is a polyolefin.

5. A blasting charge of claim 1 wherein said explosive is a water-bearing explosive, and the flexural modulus of the tubing material and the wall thickness and the diameter of said tubing are such that the tubing can be coiled to a diameter in the range of about from 15 to 50 inches without kinking.

6. A blasting charge of claim 5 wherein at least one end of said length of tubing is provided with means for retaining said water-bearing explosive therein.

7. A blasting charge of claim 6 wherein said means for retaining said explosive in said tubing is an approximately 180° bend near the end of the tubing combined with a sleeve which fits around and frictionally engages the bent-back portion of tubing and the portion of tubing adjacent thereto.

8. A blasting assembly comprising, in a borehole:

a. a sinuous length of tubing laden with and supporting a substantially continuous column of explosive, said tubing being sufficiently rigid as to exert pressure against the wall of the borehole;

b. means at the leading end of said length of tubing for retaining said explosive therein; and c. a length of detonating cord having one end embedded within said explosive near the trailing end of said length of tubing, said detonating cord passing through a slot in the wall of said tubing, being anchored to said tubing, and having its other end in communication with a source of initiation energy.

9. A blasting assembly of claim 8 wherein a cylindrical stiffening member fits around said detonating cord at the end thereof embedded within said explosive, said cord end being knotted to enable said stiffening member to be retained on said cord.

10. A method of loading explosive into a borehole comprising a. providing a length of tubing, which is laden with and supports a substantially continuous column of explosive, in the form of a coil having a diameter in the range of about from 15 to 50 inches, an end of said tubing being provided with means for retaining the explosive therein; and b. unwinding and feeding the coiled explosive-laden tubing into a borehole having a diameter which is smaller than the outer diameter of the coil, the tubing being sufficiently rigid that the explosive-laden tubing fed into said borehole retains a degree of curvature and exerts pressure against the wall of the borehole, the end of the explosive-laden tubing provided with means for retaining the explosive in the tubing being the leading end thereof.

11. A method of claim 10 wherein said explosive is a water-bearing explosive and is pumped into said coiled length of tubing.

* * * * *